US005816497A

United States Patent [19]

Leon et al.

[11] Patent Number: 5,816,497

[45] Date of Patent: Oct. 6, 1998

[54] WATER-SAVING DIFFUSER AND WATER DISTRIBUTION SYSTEM HAVING WATER FIXTURES WITH VARIABLE WATER-SAVING DIFFUSERS

[75] Inventors: Stephen Leon; Eric Leon; David Leon, all of Boca Raton, Fla.

[73] Assignee: Water Management Equipment Ltd., Boca Raton, Fla.

[21] Appl. No.: 745,614

[22] Filed: Nov. 7, 1996

[51] Int. Cl.[6] ..... B05B 15/00

[52] U.S. Cl. ..... 239/76; 239/208; 239/553.3; 137/357; 137/801; 4/678

[58] Field of Search ..... 239/76, 200, 208, 239/209, 548, 551, 553, 553.3, 553.5; 169/16; 137/357, 801; 251/122; 138/41, 44; 4/678, 675

[56] References Cited

U.S. PATENT DOCUMENTS

| | | | |
|---|---|---|---|
| 1,843,759 | 2/1932 | Chipman | 239/170 |
| 1,884,475 | 10/1932 | Woodcock | 239/170 |
| 2,489,542 | 11/1949 | Rosenblum | 251/120 |
| 2,761,662 | 9/1956 | Goodrie | 239/548 |
| 2,890,835 | 6/1959 | Fillung | 239/548 |
| 3,138,332 | 6/1964 | Hinderer | 239/427 |
| 3,630,444 | 12/1971 | Nelson | 239/29 |
| 3,662,406 | 5/1972 | Giglio | 4/678 |
| 3,831,860 | 8/1974 | Gullaksen et al. | 239/500 |
| 3,999,714 | 12/1976 | Lang | 239/570 |
| 4,082,225 | 4/1978 | Haynes | 239/428.5 |
| 4,161,965 | 7/1979 | Merritt | 138/45 |
| 4,248,270 | 2/1981 | Ostrowski | 138/45 |
| 4,568,027 | 2/1986 | Lazarus | 239/590.3 |
| 4,624,415 | 11/1986 | Hofstetter, Jr. | 239/590.3 |
| 4,870,986 | 10/1989 | Barrett et al. | 137/119 |
| 5,107,883 | 4/1992 | Shaw | 137/357 |
| 5,184,641 | 2/1993 | Kuhn | 137/504 |
| 5,242,119 | 9/1993 | Jariyasunant | 239/590.3 |
| 5,381,957 | 1/1995 | Bianco | 239/99 |
| 5,651,531 | 7/1997 | Lu | 251/229 |

FOREIGN PATENT DOCUMENTS

| | | | |
|---|---|---|---|
| 206015 | 7/1994 | Japan | 239/552 |
| 474090 | 10/1937 | United Kingdom | 239/552 |

*Primary Examiner*—Andres Kashnikow
*Assistant Examiner*—Lisa Ann Douglas
*Attorney, Agent, or Firm*—Cooper & Dunham LLP

[57] ABSTRACT

A water-saving diffuser for which a user perceives a relatively higher flow rate than the actual flow rate includes a hollow barrel for housing an accelerator disk having a plurality of apertures, a distributor disk having a central aperture of a predetermined size, and a chamber ring interposed between the distributor disk and the accelerator disk to define a chamber region therebetween. The central aperture of the distributor disk can be custom-tailored to produce a specific flow rate for a given water supply pressure. The water-saving diffuser may be used in a water distribution system to provide a predetermined uniform flow rate to all regions of a multi-story building.

11 Claims, 10 Drawing Sheets

FIG.6

| | 35 psi | 40 psi | 45 psi | 50 psi | 55 psi | 60 psi |
|---|---|---|---|---|---|---|
| 0.042" | 0.23 | 0.25 | 0.27 | 0.29 | 0.31 | 0.32 |
| 0.046" | 0.28 | 0.30 | 0.33 | 0.34 | 0.38 | 0.50 |
| 0.052" | 0.38 | 0.40 | 0.42 | 0.50 | 0.52 | 0.54 |
| 0.055" | 0.45 | 0.48 | 0.50 | 0.55 | 0.56 | 0.60 |
| 0.059" | 0.47 | 0.50 | 0.54 | 0.59 | 0.60 | 0.62 |
| 0.063" | 0.50 | 0.52 | 0.61 | 0.62 | 0.63 | 0.64 |
| 0.067" | 0.52 | 0.60 | 0.67 | 0.70 | 0.76 | 0.87 |
| 0.070" | 0.53 | 0.68 | 0.76 | 0.79 | 0.81 | 0.93 |
| 0.073" | 0.61 | 0.70 | 0.77 | 0.81 | 0.83 | 0.94 |
| 0.076" | 0.62 | 0.76 | 0.88 | 0.92 | 0.94 | 1.00 |
| 0.078" | 0.63 | 0.79 | 0.89 | 0.93 | 1.00 | 1.04 |
| 0.081" | 0.68 | 0.81 | 0.90 | 0.94 | 1.05 | 1.07 |
| 0.084" | 0.70 | 0.82 | 0.91 | 1.00 | 1.07 | 1.18 |
| 0.091" | 0.72 | 0.89 | 1.00 | 1.01 | 1.09 | 1.40 |
| 0.093" | 0.74 | 1.00 | 1.28 | 1.36 | 1.44 | 1.50 |
| 0.096" | 1.00 | 1.20 | 1.30 | 1.44 | 1.55 | 1.62 |
| 0.098" | 1.17 | 1.25 | 1.39 | 1.46 | 1.62 | 1.76 |

| FLOOR | WATER SUPPLY PRESSURE (psi) | CENTRAL APERTURE DIAMETER (inch) | FLOW RATE (gpm) |
|---|---|---|---|
| 6 | 38.355 | 0.063 | 0.50 |
| 5 | 42.684 | 0.059 | 0.50 |
| 4 | 47.013 | 0.055 | 0.50 |
| 3 | 51.342 | 0.052 | 0.50 |
| 2 | 55.671 | 0.052 | 0.50 |
| 1 | 60.000 | 0.046 | 0.50 |

FIG. 10

WATER-SAVING DIFFUSER AND WATER DISTRIBUTION SYSTEM HAVING WATER FIXTURES WITH VARIABLE WATER-SAVING DIFFUSERS

BACKGROUND

The present invention relates generally to a water-saving diffuser that attaches to a water fixture, such as a faucet or a shower supply pipe, and a water distribution system that utilizes water-saving diffusers to produce a uniform flow rate of water for a multi-story building. More specifically, the present invention relates to water-saving diffusers for which a user perceives a relatively higher flow rate than the actual flow rate. The water-saving diffusers may be adapted to produce a predetermined flow rate so that a water distribution system using these water-saving diffusers can provide each outlet of each floor of a multi-story building with the same flow rate.

The availability of fresh water is a major concern in many parts of the world, especially in regions that have a limited natural supply of fresh water and, therefore, must purchase fresh water at great cost. Some communities have resorted to imposing severe restrictions on non-essential uses of water, such as for washing cars or watering lawns. In addition, ecological concerns have prompted an interest in water conservation as a means to reduce the amount of energy expended in water treatment plants that ensure that the water supplied to a community meets a minimum standard of quality.

In general, a water conservation device conserves water by limiting the flow rate of water from a faucet or shower head. This is usually accomplished by reducing the cross-sectional area through which the water must flow. For example, flow can be restricted by using a disk having one or more small perforations to limit the flow rate of water downstream of the disk. Typical flow restricting devices provide a downstream flow rate of about 1.5 to 2.5 gallons per minute at a 60 psi water supply pressure. However, conventional flow reducing devices reduce the perceived flow velocity as well as the flow rate. This results in a user perceiving the water to trickle out of the faucet or shower head, which is unsatisfactory for rinsing greasy dishes or removing shampoo from the user's hair.

A typical water distribution system, such as one for an multi-story apartment building, utilizes conventional flow reducing devices to conserve water. Therefore, such a typical water distribution system indiscriminately reduces water flow to all apartments regardless of the floor of a particular apartment. However, gravity effects will cause apartments located on an upper floor to have a comparatively lower flow rate of water than ground floor apartments. Also, for expansive apartment complexes, distance effects will cause apartments located at a relatively farther distance from the main water supply to have a comparatively lower flow than apartments located at a relatively short distance away from the main water supply. These effects result in an inequitable distribution of water in typical water distribution systems. In addition, conventional water distribution systems generally will provide an oversupply of water in order to ensure that locations farthest from the main water supply will at least meet minimum flow standards, such as a minimum flow rate.

OBJECTS AND SUMMARY OF THE INVENTION

In view of the aforementioned shortcomings of conventional flow reducing devices and water distribution systems, it is an object of the present invention to provide a water-saving diffuser that attaches to a faucet or shower supply pipe and reduces the flow rate of water without significantly reducing the perceived flow velocity of water exiting the diffuser.

It is another object of the present invention to provide a water-saving diffuser that is easily adapted to produce a predetermined flow rate.

It is a further object of the present invention to provide a water distribution system that produces a uniform flow rate of water for a multi-story building.

According to an aspect of the present invention, a water-saving diffuser includes a hollow barrel having an upstream end adapted for attaching to a faucet or a shower supply pipe and a downstream end provided with an inwardly extending ledge. The barrel is adapted to receive an accelerator disk having a plurality of apertures, a distributor disk having a central aperture of a predetermined size, and a chamber ring interposed between the distributor disk and the accelerator disk to define a chamber region therebetween. The ledge at the downstream end of the barrel serves to retain the accelerator disk, the chamber ring, and the distributor disk within the barrel. The distributor disk is removable and the central aperture can be custom-tailored to produce a specific flow rate for a given water supply pressure.

According to another aspect of the present invention, a water distribution system includes water-saving diffusers having distributor disks with central apertures custom-tailored to produce a uniform flow rate throughout a multi-story building.

According to yet another aspect of the present invention, a method for conserving water and producing a uniform water distribution throughout a multi-story building includes the steps of determining the water supply pressure and flow characteristics for various floors at various locations of the multi-story building, and determining an appropriate central aperture size for a distributor disk of a water-saving diffuser for a selected location on a selected floor based on the water supply pressure and flow characteristics determined for that location and that floor.

The water-saving diffuser of the present invention is a device for reducing water flow for which a user perceives a relatively higher flow than the actual flow. The primary advantage of such a device is that the user reduces water consumption without being made consciously aware of doing so by the perceived slow flow of water coming through the faucet or shower head, which is a common disadvantage of many existing flow restricting devices.

The perceived high flow of the water-saving diffuser of the present invention probably is a result of its dimensions, particularly the dimensions of the distributor disk, the accelerator disk, and the chamber ring separating the distributor and accelerator disks. However, the exact mechanism responsible for the perceived high flow is not yet clearly understood. At one extreme, a certain choice of dimensions may produce a laminar flow, such as the flow typically found in water fountains where the stream of water produces little splashing. Laminar flow is likely to be perceived as being a slow flow. At the other extreme, a certain choice of dimensions may produce a turbulent flow, such as that produced when a garden hose is pinched off to produce a high-velocity jet of water. Turbulent flow is likely to be perceived as being a fast flow. The water-saving diffuser device of the present invention most likely produces a flow somewhere between these two extremes.

The water distribution system of the present invention provides a uniform flow rate of water to all locations in a multi-story building by custom-tailoring the water-saving diffusers used in different parts of the building to balance the water flow in the building.

By incorporating the water-saving diffuser of the present invention in the water distribution system of the present invention, the water consumption in a multi-story building can be significantly reduced without reducing the water velocity to an unacceptable trickle and without having an inequitably lower flow rate at higher floors than at lower floors.

BRIEF DESCRIPTION OF THE DRAWINGS

FIG. 6 is a chart showing a relationship between central aperture diameter, water supply pressure, and water flow rate for a water-saving faucet diffuser according to an embodiment of the present invention;

FIG. 10 is a chart showing flow characteristics of a multi-story building utilizing a water distribution system according to an embodiment of the present invention.

DETAILED DESCRIPTION OF PREFERRED EMBODIMENTS

Figure 1:
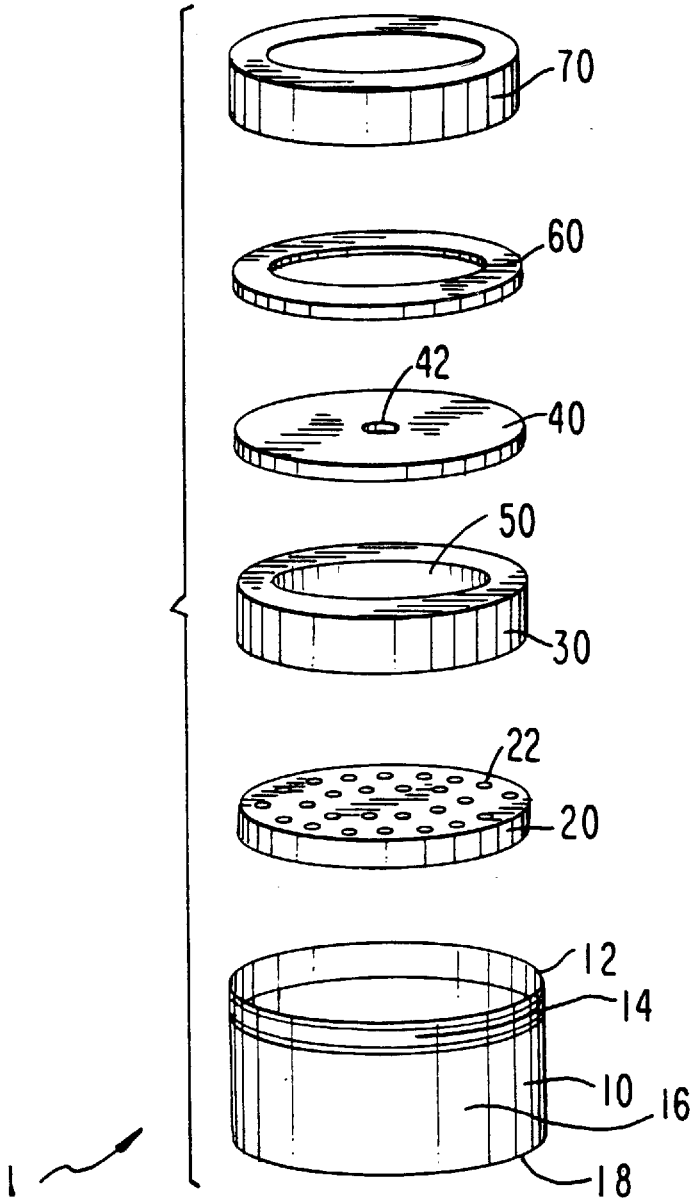
FIG. 1 shows an exploded perspective view of a water-saving diffuser according to an embodiment of the present invention.

Preferred embodiments of the present invention are described below with reference to the accompanying drawings, in which like reference numerals represent the same or similar elements.

FIG. 1 is an exploded perspective view of one embodiment of the present invention. According to this embodiment, a water-saving diffuser 1 is comprised of a hollow barrel 10, an accelerator disk 20, a chamber ring 30, and a distributor disk 40. The barrel 10 is adapted to house the accelerator disk 20, the chamber ring 30, and the distributor disk 40 therein. The chamber ring is interposed between the accelerator disk 20 and the distributor disk 40 and defines a chamber region 50 therebetween. The accelerator disk 20 is positioned downstream of the distributor disk 40. The water-saving diffuser 1 of this embodiment reduces the water flow rate by at least 35%.

Figure 2B:
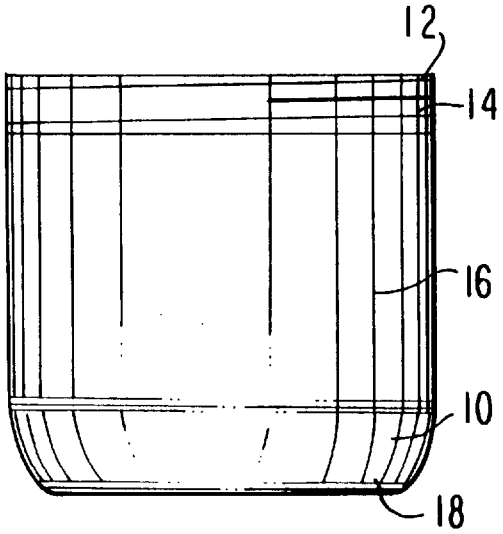
FIGS. 2A and 2B show a plan view and a side view, respectively, of a barrel according to the embodiment of FIG. 1.
Figure 2A:
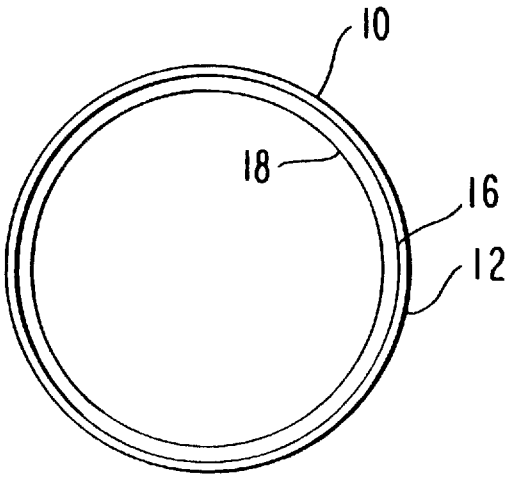

FIGS. 2A and 2B show a plan view and a side view, respectively, of the barrel 10 of FIG. 1. The barrel 10 has an upstream end 12 provided with threads 14 for attaching to a faucet or a shower supply pipe, a main body portion 16, and a downstream end 18 that has a smaller inner diameter (ID) than the ID of the main body portion 16 of the barrel 10.

In FIG. 2B, the threads 14 are shown as external threads for mating with a faucet or shower supply pipe having corresponding internal threads. However, the barrel 10 may instead be provided with internal threads (not shown) for mating with a faucet or shower supply pipe having corresponding external threads.

The downstream end 18 of the barrel 10 may be formed to have a rounded profile, as shown in FIG. 2A, or it may include an inwardly extending ledge (not shown). The smaller ID of the downstream end 18 relative to the ID of the main body portion 16 of the barrel 10 serves to retain the accelerator disk 20, chamber ring 30, and distributor disk 40 within the barrel 10.

According to a preferred embodiment for use with a standard-sized water faucet, the barrel 10 has a height of about 0.65 inch, an outer diameter (OD) of about 0.93 inch at the main body portion 16, an ID of about 0.83 inch at the main body portion 16, and an ID of about 0.81 inch at the downstream end 18. Of course, other dimensions are necessary for non-standard-sized water faucets and shower supply pipes.

Figure 3B:
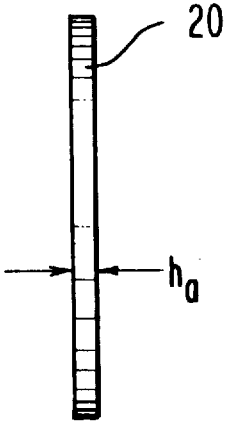
FIGS. 3A and 3B show a plan view and a side view, respectively, of an accelerator disk according to the embodiment of FIG. 1.
Figure 3A:
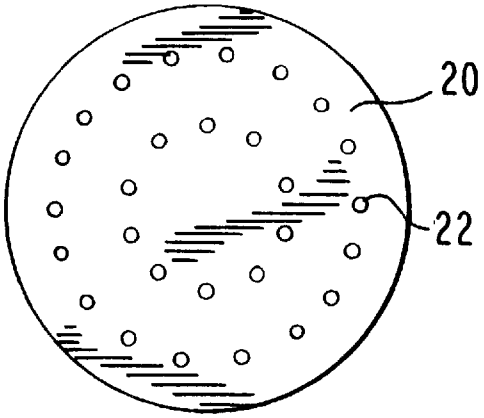

FIGS. 3A and 3B show a plan view and a side view, respectively, of the accelerator disk 20 according to the embodiment of FIG. 1. The accelerator disk 20 contains a plurality of apertures 22 formed therein for producing a spray of water downstream of the water-saving diffuser 1.

According to a preferred embodiment, the accelerator disk 20 has a diameter of about 0.82 inch and a thickness, $h_a$, of about 0.08 inch. Each of the apertures 22 has a diameter of about 0.03 inch, a total number of apertures 22 is approximately 28, and the apertures 22 are arranged such that none of the apertures 22 is located in a central portion of the accelerator disk 20.

Figure 4B:
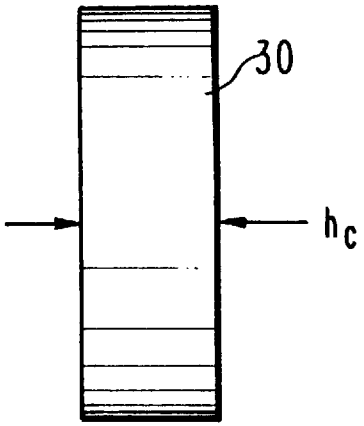
FIGS. 4A and 4B show a plan view and a side view, respectively, of a chamber ring according to the embodiment of FIG. 1.
Figure 4A:
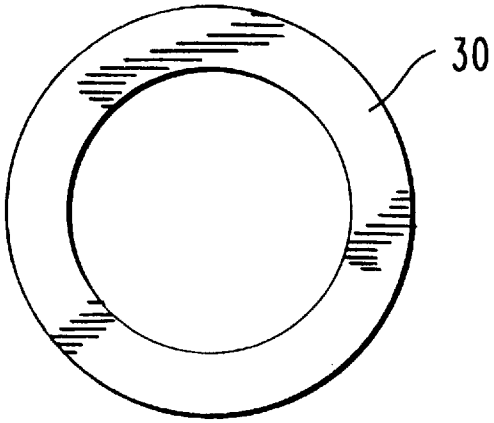

FIGS. 4A and 4B show a plan view and a side view, respectively, of the chamber ring 30 according to the embodiment of FIG. 1. The chamber ring 30 has an annular shape and may be formed as a discrete ring or as a physical extension of the accelerator disk 20.

According to a preferred embodiment, the chamber ring 30 has a height, $h_c$, of about 0.25 inch, an OD of about 0.83 inch, and an ID of about 0.605 inch.

Figure 5B:
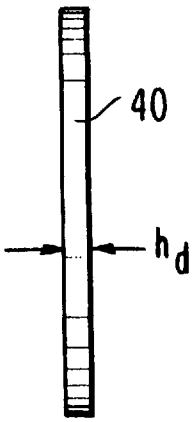
FIGS. 5A and 5B show a plan view and a side view, respectively, of a distributor disk with a central aperture according to the embodiment of FIG. 1.
Figure 5A:
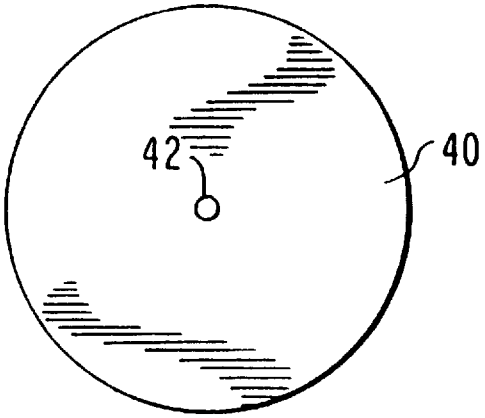

FIGS. 5A and 5B show a plan view and a side view, respectively, of the distributor disk 40 according to the embodiment of FIG. 1. The distributor disk 40 has a central aperture 42 formed therein for restricting water flow in the water-saving diffuser 1. The distributor disk 40 reduces the water flow rate by at least 35%. The distributor disk 40 is removable from the water saving diffuser 1, and can be specially adapted or custom-tailored to produce a predetermined flow rate for a known water supply pressure.

FIG. 6 is a chart showing a relationship between central aperture diameter of the distributor disk 40, water supply pressure, and water flow rate (gpm) for the water-saving diffuser 1 according to the embodiment of FIG. 1. The top row of figures represents the water supply pressure (in psi) upstream of the water-saving diffuser 1. The first column of figures on the left represents various diameters (in inches) for the central aperture 42 of the distributor disk 40. The array of values below the top row and to the right of the first column on the left represent water flow rates (in gallons per minute or gpm) downstream of the water-saving diffuser 1. For example, according to FIG. 6, for a given water supply pressure of 50 psi, a water-saving diffuser 1 having a distributor disk 40 with a 0.052 inch-diameter central aperture 42 will provide a flow rate of 0.5 gpm. Likewise, for a given water supply pressure of 35 psi, a water-saving diffuser 1 having a distributor disk 40 with a 0.063 inch-diameter central aperture 42 will provide the same flow rate of 0.5 gpm. By way of comparison, a standard diffuser may have a flow rate of 2.0 gpm at the same water supply pressure. However, a user will not perceive the difference in flow rate. Note that for water supply pressures above 60 psi (not shown in FIG. 6), the flow rate is correspondingly higher for each central aperture diameter shown in the first column on the left, and for water supply pressures below 35 psi (not shown in FIG. 6), the flow rate is correspondingly lower for each central aperture diameter shown in the first column on the left. In other words, in order to maintain a constant flow rate for pressures that are higher or lower than what is shown in FIG. 6, the corresponding central aperture diameter is smaller for higher pressures and larger for lower pressures.

According to a preferred embodiment, the distributor disk has a thickness, $h_d$, of about 0.08 inch and an OD of about 0.82 inch. The central aperture 42 has a diameter that ranges from about 0.025 inch to 0.125 inch.

Additionally, the water-saving diffuser may include a washer 60 and a spacer 70 positioned upstream of the distributor disk 40, as shown in FIG. 1.

Figure 7:
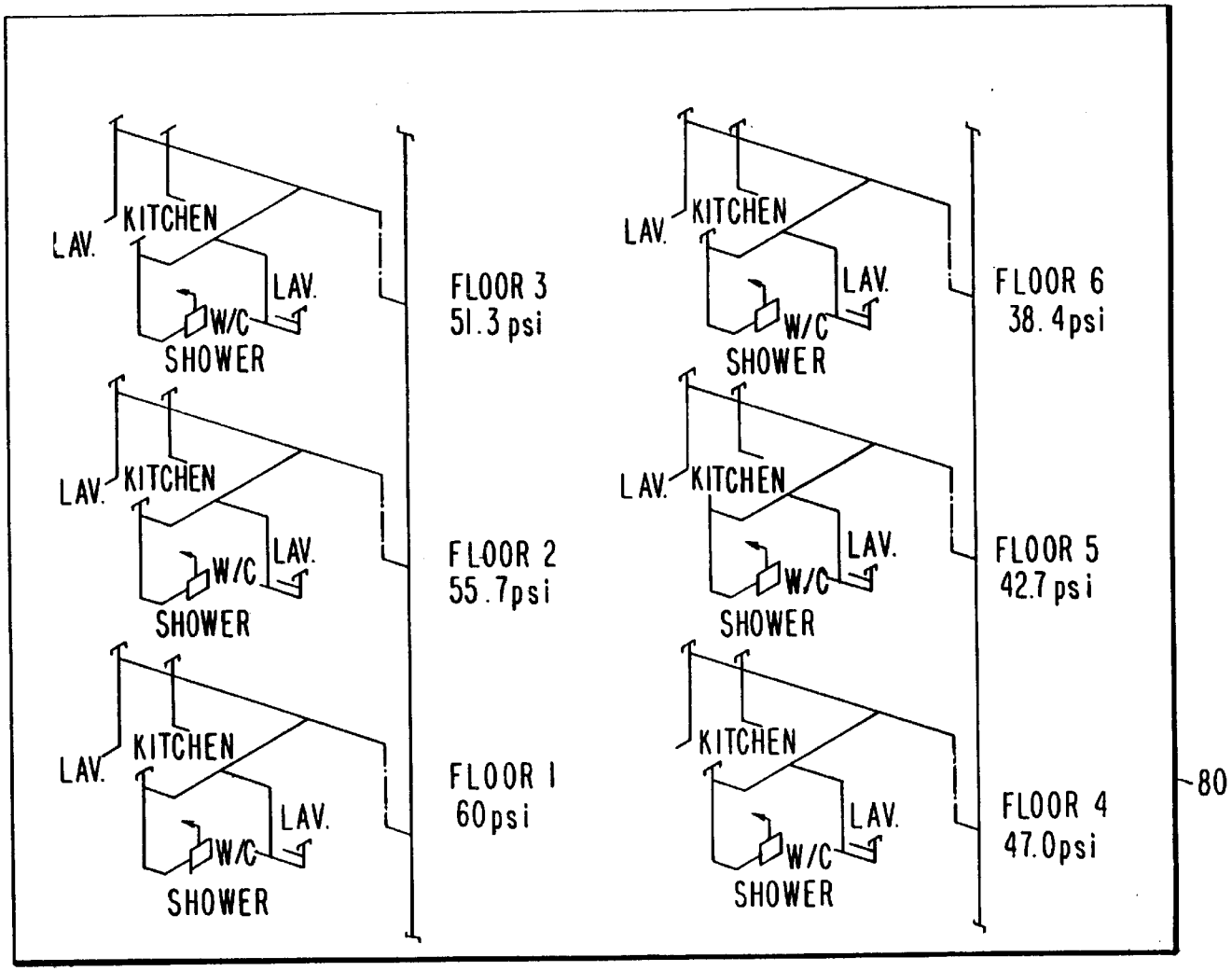
FIG. 7 schematically shows a typical building with isometric floors.

According to another embodiment of the present invention, a water distribution system that produces a uniform flow rate throughout a multi-story building is provided. The water distribution system takes into account a natural pressure drop in the water supply due to gravity effects and distance effects, which cause regions of the building farthest from the main water supply to have a comparatively lower flow rate than regions closer to the main water supply. FIG. 7 schematically shows a typical multi-story building 80 with isometric floors for which the water supply pressure varies from floor to floor due to gravity effects. The water distribution system of the present invention compensates for these naturally-occurring effects by utilizing water-saving diffusers 1 with distributor disks 40 having various central aperture diameters. The central aperture diameter selected for a specific location in the building is dependent on the water supply pressure determined for that location.

Figure 8:
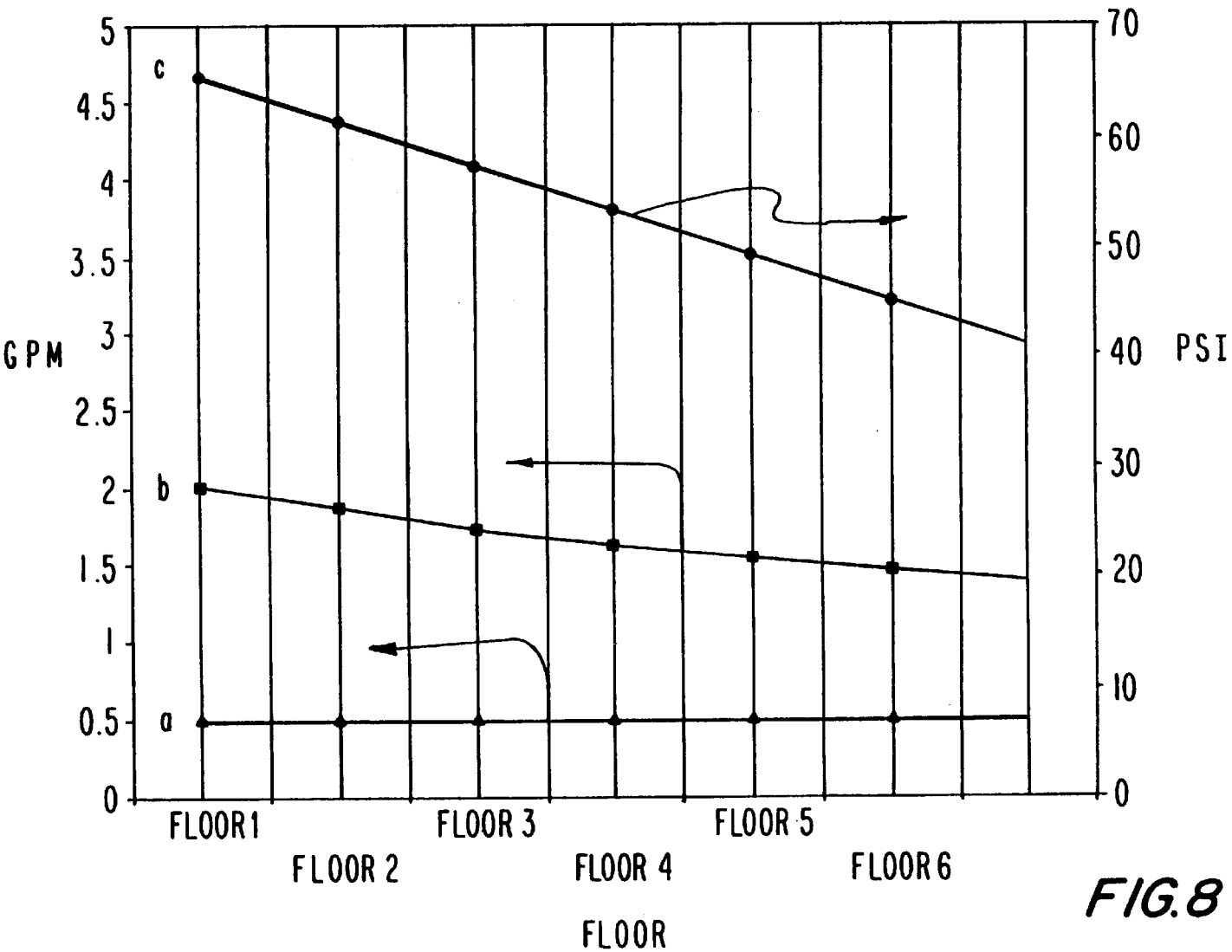
FIG. 8 is a graph comparing a water distribution system according to an embodiment of the present invention with a typical water distribution system.

FIG. 8 is a graph comparing the water distribution system of the present invention with a typical water distribution system that uses conventional water-saving diffusers for a six-story building. Curve c represents the water supply pressure (psi) for each floor of the building, curve a represents the flow rate (gpm) when the water distribution system of the present invention is used, and curve b represents the flow rate (gpm) when a typical water distribution system with conventional water-saving devices is used. As shown in FIG. 8, the typical water distribution system provides a flow rate that varies with floor while the water distribution system of the present invention provides a uniform flow rate for all floors of the building. In addition, the water distribution system of the present invention conserves more water than the typical water distribution system.

Figure 9:
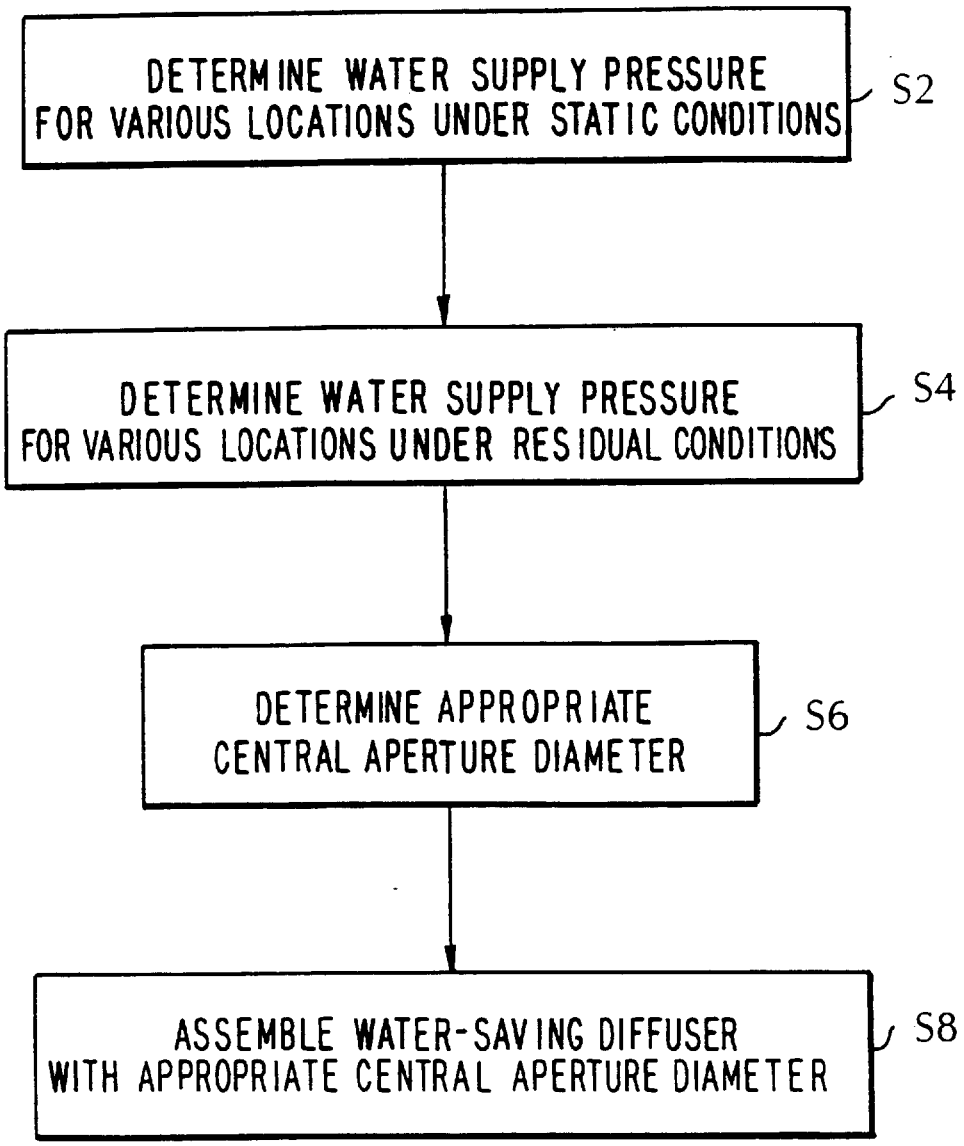
FIG. 9 is a flow chart describing a method for providing a uniform flow rate to all regions of a multi-story building according to an embodiment of the present invention.

FIG. 9 is a flow chart describing a method for producing a predetermined uniform flow rate to all regions of a multi-story building according to an embodiment of the present invention. First, the water supply pressure for various locations in the building is determined under static conditions at step S2. Static conditions are conditions in which no water is used in the building. Next, at step S4, the water supply pressure for the various locations is determined under residual conditions, which are normal or typical daily water use conditions. Then, the appropriate central aperture diameter for the distributor disk 40 of the water-saving diffuser 1 for producing the predetermined flow rate is determined for each of the various locations at step S6. The appropriate water-saving diffuser 1 is determined based upon the static and residual water supply pressures determined for the various locations. The appropriate water-saving diffuser 1 is then installed at the various locations at step S8.

By way of example, FIG. 10 is a chart for a 6-story building indicating a gravity-induced water-supply pressure drop that increases with elevation. A main supply pressure of 60 psi on the first floor decreases to only about 38 psi on the sixth floor. By choosing the central aperture diameters of the water-saving diffusers according to a chart similar to that of FIG. 6, all the floors of the 6-story building can be provided with a flow rate of 0.5 gpm.

By combining the water-saving diffuser of the present invention with the water distribution system of the present invention, water consumption can be significantly decreased while providing users with a satisfactory water flow velocity so that users can rinse away shampoo or grease from dishes without perceiving that the water is trickling out of the shower head or faucet.

The cost savings achieved by the present invention can be significant. In a large apartment complex of 260 apartments using 50,000 to 75,000 gallons of water per day, or as much as 27,375,000 gallons per year, the savings can be as much as 3,000,000 to 6,000,000 gallons per year, or as much as $14,000 to $27,000 per year, depending on the cost of supplied water.

The embodiments described above are illustrative examples of the present invention and it should not be construed that the present invention is limited to these particular embodiments. Various changes and modifications may be effected by one skilled in the art without departing from the spirit or scope of the invention as defined in the appended claims. For example, the specific dimensions stated above are for standard-sized water faucets, and these dimensions may be modified to accommodate non-standard-sized water faucets and also shower supply pipes without departing from the scope of this invention.

What is claimed is:

1. A water-saving diffuser, comprising:

a hollow barrel having an upstream end for attachment to a water supply, a main body portion, and a downstream end with a smaller inner diameter than an inner diameter of the main body portion of the barrel;

an accelerator disk having a plurality of apertures formed therein for producing a spray of water;

a distributor disk having a central aperture formed therein for reducing a water flow rate; and a chamber ring interposed between the accelerator disk and the distributor disk to form a chamber region therebetween, the chamber ring having a height that is smaller than its diameter;

the accelerator disk, distributor disk, and chamber ring being housed within the hollow barrel such that the accelerator disk is positioned downstream from the distributor disk and being retained in the barrel by the smaller inner diameter of the downstream end of the barrel relative to the main body portion of the barrel.

2. A water-saving diffuser according to claim 1, wherein the plurality of apertures in the accelerator disk are arranged such that none of the apertures is located in a central region of the accelerator disk opposing the central aperture of the distributor disk.

3. A water-saving diffuser according to claim 1, wherein the chamber ring has a height of about 0.15 to 0.35 inch, an outer diameter of about 0.75 to 0.95 inch, and an inner diameter of about 0.50 to 0.70 inch.

4. A water-saving diffuser according to claim 1, wherein the chamber ring is attached to the accelerator disk.

5. A water-saving diffuser according to claim 1, wherein the central aperture of the distributor disk has a diameter that ranges from about 0.025 to 0.125 inch.

6. A water-saving diffuser according to claim 1, wherein the distributor disk has a thickness of about 0.07 to 0.09 inch.

7. A water-saving diffuser according to claim 1, wherein the accelerator disk has a thickness of about 0.07 to 0.09 inch and the plurality of apertures in the accelerator disk each have a diameter of about 0.02 to 0.04 inch.

8. A water distribution system for providing a multi-story building with a predetermined uniform water flow rate, the system comprising:

a plurality of faucets and shower supply pipes located at various parts of a multi-story building, each of the faucets and shower supply pipes for supplying water at a known water supply pressure;

a plurality of water-saving diffusers for attaching to the plurality of faucets and shower supply pipes, each of the water-saving diffusers having a distributor disk with a central aperture for significantly reducing a flow rate of the water;

wherein each water-saving diffuser selected for use at one of the various parts of the multi-story building has a central aperture diameter that depends on the known water supply pressure for that part of the multi-story building.

9. A water distribution system according to claim 8, wherein each of the water-saving diffusers further comprise:

a barrel, an accelerator disk with a plurality of apertures formed therein, and a chamber ring interposed between the accelerator disk and the distributor disk to form a chamber region therebetween, the chamber ring having a height that is smaller than its diameter.

10. A method of providing a predetermined uniform water flow rate to a multi-story building, the method comprising the steps of:

determining a water supply pressure for each of various locations in a multi-story building;

determining a diameter for a water-restricting aperture of a water-saving diffuser for each of the various locations based on the water supply pressure determined for each respective location; and assembling a water-saving diffuser for each of the various locations by inserting a disk having a central water-restricting aperture into the water-saving diffuser, the diameter of the water-restricting aperture being determined based on the water supply pressure for each respective location.

11. A method according to claim 10, wherein the step of determining the water supply pressure for each of the various locations in the multi-story building includes determining the water supply pressure under static conditions and under residual conditions.

* * * * *